US007013819B2

(12) United States Patent
Sanchez et al.

(10) Patent No.: US 7,013,819 B2
(45) Date of Patent: Mar. 21, 2006

(54) MARINE CATAMARAN PLATFORM

(76) Inventors: Jean-Claude Sanchez, 10 Villa de la Grappe, La Ferte Alais (FR) 91590; Jean-Philippe Sanchez, 10 Villa de la Grappe, La Ferte Alais (FR) 91590; Pierre Jagourd, Quartier Ibarron, Saint Pee sur Nivelle (FR) 64310

( * ) Notice: Subject to any disclaimer, the term of this patent is extended or adjusted under 35 U.S.C. 154(b) by 0 days.

(21) Appl. No.: 11/070,040

(22) Filed: Mar. 2, 2005

(65) Prior Publication Data

US 2005/0211148 A1 Sep. 29, 2005

(30) Foreign Application Priority Data

Mar. 5, 2004 (FR) ..... 04 02319
Mar. 5, 2004 (FR) ..... 04 02320
Mar. 5, 2004 (FR) ..... 04 02321
Mar. 5, 2004 (FR) ..... 04 02322

(51) Int. Cl.
*B63B 1/00* (2006.01)

(52) U.S. Cl. ..... 114/61.2; 114/61.1

(58) Field of Classification Search ..... 114/61.1, 114/61.2, 61.22, 61.33
See application file for complete search history.

(56) References Cited

U.S. PATENT DOCUMENTS 3,883,909 A * 5/1975 Fisher et al. ..... 114/352
4,715,306 A * 12/1987 Horais ..... 114/61.1
6,095,073 A * 8/2000 Burkett ..... 114/61.1
6,871,608 B1 * 3/2005 Rosen ..... 114/61.1

* cited by examiner

*Primary Examiner*—Lars A. Olson
(74) *Attorney, Agent, or Firm*—H. Michael Brucker

(57) ABSTRACT

A marine catamaran platform especially advantageous for small boats (in the three meter range) in which two substantially identical hulls are surmounted by superstructures that are joined by arced beams that lie in a plane that forms an acute angle of between 30° and 60° with a plane common to the hulls.

11 Claims, 2 Drawing Sheets

MARINE CATAMARAN PLATFORM

FIELD OF THE INVENTION

The present invention relates to a compact, high-performance, durable marine catamaran platform for a water craft propelled by sail, oar or motor.

BACKGROUND OF THE INVENTION

By definition, a catamaran is an oar-, sail-, and/or motor-propelled boat consisting of two identical parallel hulls joined by means of cross-beams, fabric, netting, a floor, a cabin, or a combination of these various components.

Known forms include large sailing catamarans, habitable or not, designed for pleasure or competitive sailing on the open sea.

Known forms also include smaller catamarans, collapsible or not, that can be transported on low-bed trailers or even, for the smallest crafts, on the roof of a small car.

However, the structure and performance characteristics of known models in the smaller category that have been available prior to the present invention are more suitable for children than for adults attracted by the sporting aspect.

The object of the present invention is to provide a lightweight, high-performance, compact sailing catamaran platform with hulls as little as three meters long that can be easily transported on the roof of a small car; that possesses great structural rigidity; is capable of negotiating waves one meter high and above; of returning through surf; and which offers the performance characteristics of catamarans and other sailing craft that are much larger and are suitable for use by adults.

These and other objects, aspects and features of the present invention will be better understood from the following detailed description of the preferred embodiments when read in conjunction with the appended drawing figures.

BRIEF DESCRIPTION OF THE INVENTION

According to the invention, the compact catamaran platform consisting of a single-piece, hollow floating structure, made, for example, of fiber-reinforced molded plastic, comprising two parallel hulls joined by means of two hollow beams, is characterized in that each hull includes a superstructure forming a deck, the bow end of each superstructure sloping away from the bow end of the hull as it rises above the hull and the stern end of each superstructure sloping away from the stern of the hull as it rises above the hull. The two bow ends of the superstructures are joined by a bow arced hollow beam having a convex surface and situated in a plane that forms an acute angle with a plane containing the two hulls. The convex portion of the bow beam is directed away from the hull and toward the bow. The two stern ends of the superstructures are joined by means of a stern arced hollow beam having a convex surface and situated in a plane that forms an acute angle with a plane containing the two hulls. The convex portion of this stern beam is directed away from the hull and toward the stern.

Preferably, the bow beam and stern beam are each situated in a plane that forms a 45° angle with the plane containing the two hulls.

According to another feature of the invention, the bow beam contains at its mid-portion a molded part designed to serve as a support for the mast, and the stern beam supports a molded part designed to receive a rudder mechanism.

According to a preferred embodiment of the invention, the ratio R of the spread (distance) I between the two hulls and the distance H between the bottom of a hull and the top of the superstructure measured at the same location is between 0.35 and 0.50. (R=H/I=0.35–0.50.)

This ratio R is higher than prior art designs and has the advantage of locating a trampoline between the hulls in a higher position relative to the water level, conferring on the present invention the ability to negotiate much bigger waves than can small catamarans whose hulls are less than 3 meters long and ratios R are less than 0.35.

The superstructure is advantageously equipped with a hatch on its top surface providing access to the interior of both the superstructure and the hull which provides locker space and a place for locating a daggerboard.

For further features and benefits of the invention, reference may be made to the following detailed description in conjunction with the following drawings.

DETAILED DESCRIPTION OF THE PREFERRED EMBODIMENTS

Figure 1:
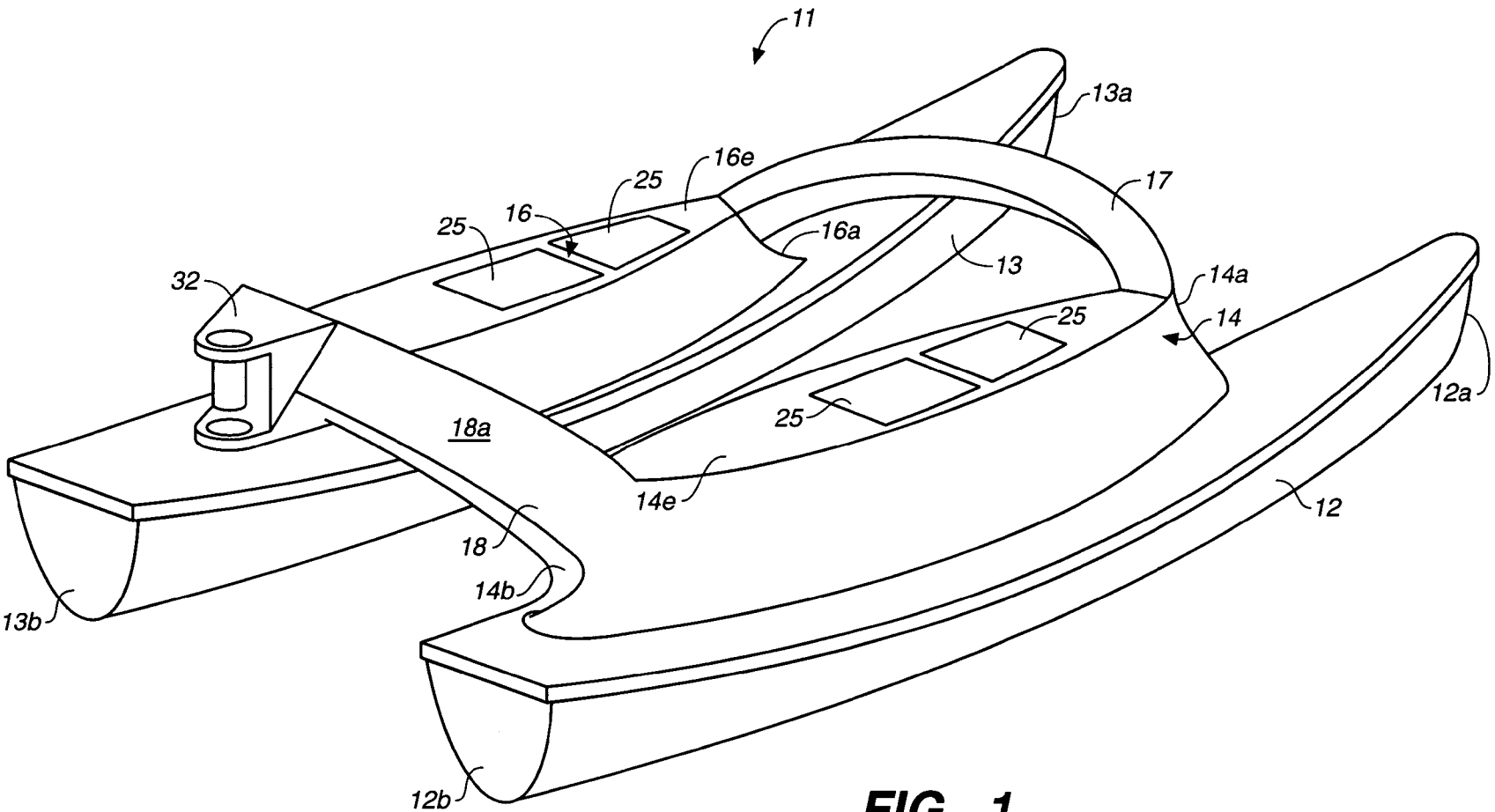
FIG. 1 is a perspective view of a catamaran platform according to the present invention.
Figure 2:
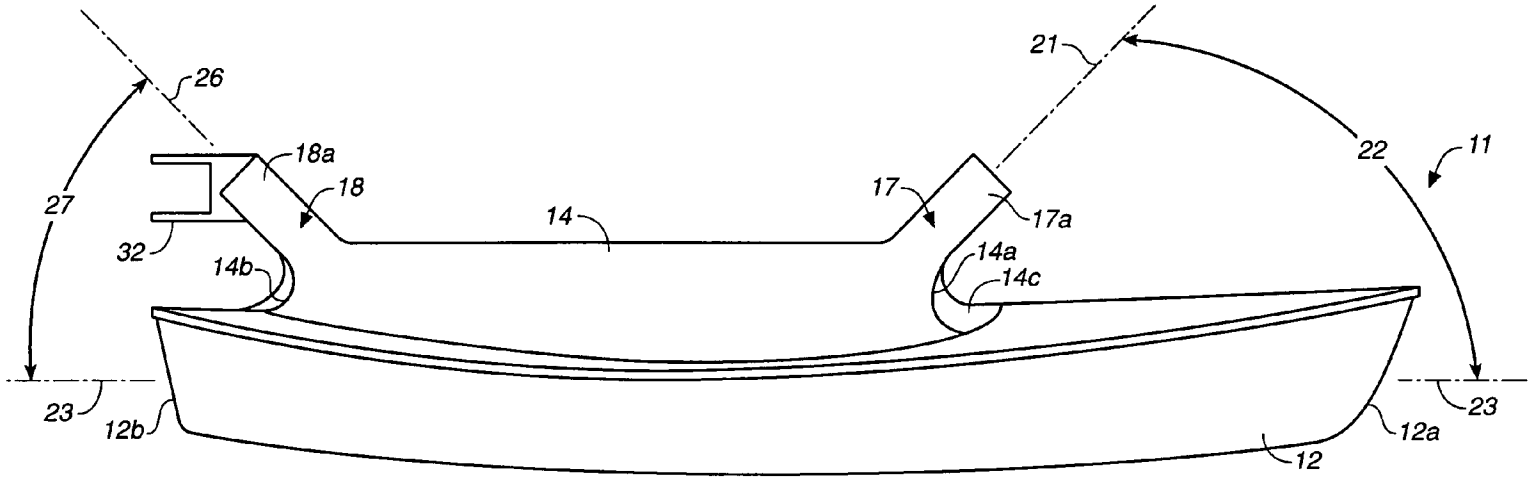
FIG. 2 is a side view of the catamaran platform.

Referring to FIGS. 1–3 and 3A, a compact marine catamaran platform 11, according to the present invention, is a hollow, integrated floating structure preferably constructed of fiber-reinforced molded plastic. Two substantially identical, parallel hollow hulls 12 and 13 have a generally V-shaped cross-section symmetrical about a centerline 36, in the case of hull 12, and centerline 34, in the case of hull 13. The centerlines 34 and 36 pass through the apex 36*a* of hull 12, and 34*a* of hull 13. Hulls 12 and 13 have bows 12*a* and 13*a*, respectively, and stems 12*b* and 13*b*, respectively. Hulls 12 and 13 are surmounted by hollow superstructures 14 and 16, respectively. Superstructure 14 has a bow end 14*a* nearest bow 12*a* and a stern end 14*b* nearest stern 12*b*. Superstructure 16 has a bow end 16*a* nearest bow 13*a* and a stern end 16*b* (not shown, but identical to stern end 14*b*) nearest stern 13*b*. One or more hatches 25 can advantageously be located in the top surface 14*e* of superstructure 14 for access to the interior of both superstructure 14 and hull 12. Superstructure 16 can be similarly equipped with hatches 25 in its top surface 16*e*.

The bow ends 14*a* and 16*a* of superstructures 14 and 16 are joined by a hollow front arced beam 17 having a convex surface 17*a* and a generally rectangular cross-section (not shown). The stern ends 14*b* and 16*b* of hollow superstructures 14 and 16 are joined by a hollow rear arced beam 18 having a convex surface 18*a* and a generally rectangular cross-section (not shown). A mast mount 20 is supported by beam 17, while a rudder mount 32 is supported by beam 18 (see FIGS. 3 and 3A).

The integrated structure formed by hulls 12 and 13, superstructures 14 and 16 and arced beams 17 and 18 provides a platform with great rigidity and outstanding performance for a small water craft.

The bow end 14*a* of superstructure 14 has a face 14*c* that slopes away from the bow 12*a* as it rises above hull 12, while the bow end 16*a* of superstructure 16 has a face 16*c* (not shown, but identical to face 14*c*) that slopes away from bow 13*a* as it rises above hull 13. The stern end 14*b* of superstructure 14 has a face 14*d* that slopes away from the stern 12*b* as it rises above the hull 12, while the stern end 16*b* of superstructure 16 has a face 16*d* (not shown, but identical to face 14*d*) that similarly slopes away from the stern 13*b* as it rises above the hull 13.

The hollow front arc beam 17 is integrally connected to superstructures 14 and 16 at their sloping faces 14*c* and 16*c*. The hollow rear arc beam 17 is integrally connected to superstructures 14 and 16 at their sloping faces 14*d* and 16*d*.

Hollow front arc beam 17 lies in a plane 21 that forms an acute angle 22, between 30° and 60°, with a plane 23 containing the two hulls 12 and 13 whereby the convex surface 17*a* of front arc beam 17 rises from superstructure faces 14*a* and 16*a* away from the hulls 12 and 13 and toward the bow ends 12*a* and 13*a*. Hollow rear arc beam 18 lies in a plane 26 that forms an acute angle 27, between 30° and 60°, with plane 23 containing the two hulls 12 and 13 whereby the convex surface 18*a* of rear arc beam 18 rises from superstructure faces 14*b* and 16*b* away from the hulls 12 and 13 and toward the stern ends 12*b* and 13*b*.

In the preferred embodiment (see FIG. 2), the front arc beam 17 and the rear arc beam 18 form angles 22 and 27, of approximately 45°, to permit easy wave negotiation with superior rigidity. Other angles within the range of angles 22 and 27 that are not the same are within the scope of the invention and are used depending on the operating characteristics desired.

Figure 3A:
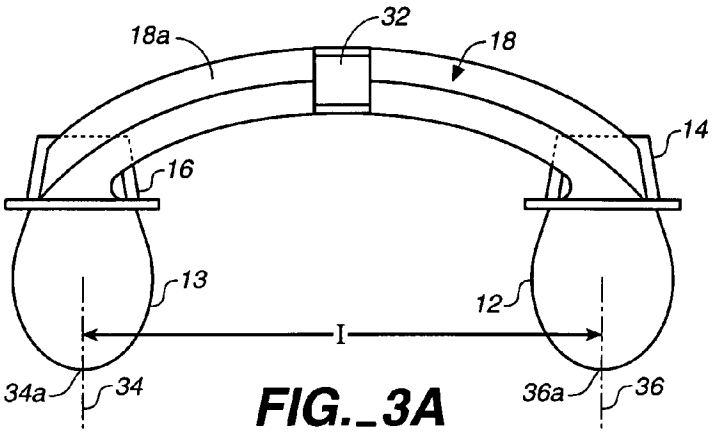
FIG. 3A is a rear view of the catamaran platform.
Figure 3:
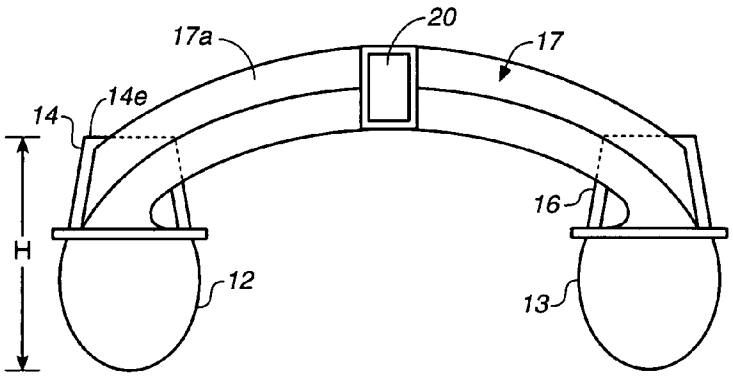
FIG. 3 is a front view of the catamaran platform.

Referring to FIGS. 3 and 3A, according to a preferred embodiment of the invention, the ratio R of the spread (distance) I between the two hulls 12 and 13, as measured from their center lines 34 and 36, respectively, and the height H measured between the apex 36 of the hull 12 and the top 14*e* of superstructure 14 at the same location along hull 12 (which is the same as the height between the bottom of the hull 13 and the top 16*e* of superstructure 16) is between 0.35 and 0.50. (R=H/I=0.35–0.50.)

Regarding the arc of beams 17 and 18, and by way of example, for a platform 11 of the present invention having a spread I of approximately 1300 mm, the arc beams 17 and 18 would, in the preferred embodiment, be an arc of a circle with a radius of approximately 850 mm. Those skilled in the art will recognize that an arc beam of a different radius and beams not a perfect arc of a circle are within the scope of the invention and could be used, and that for platforms of different dimensions, the arc beams would be scaled.

The invention as described has particular application to platforms having hulls of approximately three meters, although platforms using shorter or longer hulls also benefit from the novel design of the invention.

It will be understood by those skilled in the art that the Figures are only illustrative of the various components of the invention and their physical and functional relationship, and that the joining of the various components to form a unified, watertight vessel is well within the skill of the art such that no attempt has been made to illustrated or described the manner of doing so.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. In a marine catamaran platform, the combination comprising:

a pair of substantially identical spaced-apart hulls, each having a bow end and a stern end and a generally V-shaped cross-section substantially symmetrical about a centerline that passes through the apex of the V;

a generally hollow superstructure disposed on each said hull between their bow and stern ends wherein each said superstructure has a bow end and a stern end;

a bow arc beam having a concave surface, said beam secured to and spanning said superstructures at their bow ends;

a stern arc beam having a concave surface, said beam secured to and spanning said superstructures at their stern ends.

2. The marine catamaran platform of claim 1 wherein said hulls lie in a common plane and said bow arc beam lies in a plane that forms an acute angle between 30° and 60° with the common plane.

3. The marine catamaran platform of claim 2 wherein said stern arc beam lies in a plane that forms an acute angle between 30° and 60° with the common plane.

4. The marine catamaran platform of claim 2 wherein the angle between the common plane of said hulls and the plane of said bow arc beam is approximately 45°.

5. The marine catamaran platform of claim 4 wherein the angle between the common plane of said hulls and the plane of said stern arc beam is approximately 45°.

6. The marine catamaran platform of claim 1 wherein said superstructures have top surfaces and the ratio R of the distance between the centerlines of said hulls (I) and the distance (H) between the apex of a hull and the top surface of the superstructure on said hull, measured at the same location along said hull, is between 0.35 and 0.50 (R=H/I=0.35 to 0.50).

7. The marine catamaran platform of claim 3 wherein said superstructures have top surfaces and the ratio R of the distance between the centerlines of said hulls (I) and the distance (H) between the apex of a hull and the top surface of the superstructure on said hull, measured at the same location along said hull, is between 0.35 and 0.50 (R=H/I=0.35 to 0.50).

8. The marine catamaran platform of claim 1 further comprising:

a fitting for mounting a mast secured at said bow arc beam; and a fitting for mounting a rudder secured at said stern arc beam.

9. The marine catamaran platform of claim 1 wherein said bow arc beam and said stern arc beam have generally rectangular cross-sections.

10. The marine catamaran platform of claim 1 wherein said bow ends of said superstructures rise from their respective hulls away from said hull bows and said stern ends rise from their respective hulls away from said hull stems.

11. The marine catamaran platform of claim 3 wherein said superstructures have top surfaces, and further comprising:

at least one hatch in said top surface of said superstructure providing access to the interior of both said superstructure and said hull on which said superstructure is disposed.

* * * * *

UNITED STATES PATENT AND TRADEMARK OFFICE

CERTIFICATE OF CORRECTION

PATENT NO. : 7,013,819 B2
APPLICATION NO. : 11/070040
DATED : March 21, 2006
INVENTOR(S) : Jean-Claude Sanchez et al.

It is certified that error appears in the above-identified patent and that said Letters Patent is hereby corrected as shown below:

Column 2,
Line 40, “stems” should read -- sterns --.

Column 4,
Line 56, “stems” should read -- sterns --.

Signed and Sealed this

Twenty-seventh Day of June, 2006

JON W. DUDAS
*Director of the United States Patent and Trademark Office*